US012781752B2

(12) United States Patent
Kogame et al.

(10) Patent No.: US 12,781,752 B2
(45) Date of Patent: Nov. 3, 2026

(54) VACUUM PUMP

(71) Applicant: SHIMADZU CORPORATION, Kyoto (JP)

(72) Inventors: Masahito Kogame, Kyoto (JP); Hiroaki Kimura, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 19/005,442

(22) Filed: Dec. 30, 2024

(65) Prior Publication Data

US 2025/0257732 A1 Aug. 14, 2025

(30) Foreign Application Priority Data

Feb. 13, 2024 (JP) ..... 2024-019824

(51) Int. Cl.
*F04D 19/04* (2006.01)
*F04D 29/08* (2006.01)

(52) U.S. Cl.
CPC ..... *F04D 19/042* (2013.01); *F04D 29/083* (2013.01); *F04D 19/048* (2013.01)

(58) Field of Classification Search
CPC ..... F04D 17/165; F04D 19/04; F04D 19/042; F04D 29/002; F04D 29/023; F04D 29/08; F04D 29/083; F04D 29/40; F04D 29/102; F04D 29/122; F04D 29/20; F04D 29/2216; F04D 29/2222; F04D 29/263; F04D 29/289; F04D 29/321; F04D 29/329; F04D 29/522
See application file for complete search history.

(56) References Cited

U.S. PATENT DOCUMENTS 303,558 A * 8/1884 Campbell ..... B65D 39/12 215/360
6,106,223 A * 8/2000 Leyshon ..... F04D 19/04 415/90

(Continued)

FOREIGN PATENT DOCUMENTS

SU 1479702 A1 5/1989
TW I592577 B 7/2017

(Continued)

OTHER PUBLICATIONS

Office Action received for Taiwanese Patent Application No. 113150759, mailed on Feb. 3, 2026, 8 pages (3 pages of English Translation and 5 pages of Official Copy).

(Continued)

*Primary Examiner* — Kenneth J Hansen
(74) *Attorney, Agent, or Firm* — Renner, Otto, Boisselle & Sklar, LLP

(57) ABSTRACT

A vacuum pump includes a housing having a suction port, a rotor housed in the housing and rotationally driven to suck gas through the suction port and pump the gas, and a lid member that covers a recess of the rotor. The lid member has a cone shape having a vertex on a side close to the suction port and having a bottom on a side close to the rotor. The generatrix of the cone shape includes a first curved portion having such a curve that an angle between a tangent to the generatrix and a gas flow direction increases from a vicinity of the vertex to a vicinity of the bottom.

8 Claims, 3 Drawing Sheets

(56) References Cited

U.S. PATENT DOCUMENTS

| | | | | |
|---|---|---|---|---|
| 9,512,853 | B2 | 12/2016 | Bottomfield | |
| 2014/0369809 | A1 * | 12/2014 | Beyer | F04D 19/042 415/90 |
| 2017/0321723 | A1 | 11/2017 | Lee | |

FOREIGN PATENT DOCUMENTS

| | | | |
|---|---|---|---|
| TW | I730470 | B | 6/2021 |
| WO | 2022/181464 | A1 | 9/2022 |

OTHER PUBLICATIONS

Taiwanese Office Action for corresponding Application No. 113150759, issued Sep. 15, 2025, with English translation.

* cited by examiner

VACUUM PUMP

This application claims priority under 35 U.S.C. § 119 to Japanese Patent Application No. 2024-19824 filed on Feb. 13, 2024. The entire disclosure of Japanese Patent Application No. 2024-19824 is hereby incorporated herein by reference.

BACKGROUND OF THE INVENTION

1. Technical Field

The present invention relates to a vacuum pump.

2. Background Art

There is a vacuum pump that sucks gas from an inside of a pumping target device and pumps the sucked gas to the outside by rotating a rotor having a rotor blade. The Rotor of the vacuum pump has a recess on a suction port side for sucking gas. There is a pumping target device described above that generates a predetermined solid (e.g., product generated in the pumping target device), and the solid may flow into the vacuum pump and accumulate in the recess of the rotor. In order to prevent the solid from accumulating in the recess of the rotor, a lid member that covers the recess is provided (see, e.g., U.S. Pat. No. 9,512,853, WO 2022/181464 A).

In some cases, a conventional lid member has a planar shape or a substantially hemispherical shape. The lid member having such a shape has a large surface perpendicular to a gas flow direction by the vacuum pump. The large surface perpendicular to the gas flow direction bounces back most of solids flown into the vacuum pump in a direction opposite to the gas flow direction. That is, the lid member having the planar shape or the substantially hemispherical shape bounces back the solids flown into the vacuum pump to, e.g., a pumping target device. In addition, in some cases, a conventional lid member has a linear inclined surface. However, since the inclined surface is not sufficiently inclined, such lid member also bounces back the solids flown into the vacuum pump to the pumping target device.

Thus, an object of the present invention is to prevent a solid from bouncing out of a vacuum pump while preventing the solid from accumulating in a recess of a rotor.

SUMMARY OF THE INVENTION

The vacuum pump according to one aspect of the present invention includes a housing, a rotor, and a lid member. The housing has a suction port. The rotor is housed in the housing, and is rotationally driven to suck gas through the suction port and pump the gas. The rotor has a recess in a portion facing the suction port. The lid member covers the recess of the rotor. In the above-described vacuum pump, the lid member has a cone shape having a vertex on a side close to the suction port and having a bottom on a side close to the rotor. The generatrix of the cone shape includes a first curved portion having such a curve that an angle between a tangent to the generatrix and a gas flow direction increases from the vicinity of the vertex to the vicinity of the bottom.

The lid member of the vacuum pump according to one aspect of the present invention has the cone shape having the vertex on the side close to the suction port and having the bottom on the side close to the rotor. The generatrix of the cone shape includes the first curved portion having such a curve that the angle between the tangent to the generatrix and the gas flow direction increases from the vicinity of the vertex to the vicinity of the bottom. The lid member in such a shape has a surface at an angle close to the gas flow direction on the side close to the suction port. Thus, on the surface of the lid member on the side close to the suction port, a solid is not bounced toward the suction port, and does not come out of the vacuum pump. On the other hand, the surface of the lid member on the side close to the bottom is placed at a position close to an angle perpendicular to the gas flow direction but away from the center of the lid member. Thus, on the side close to the bottom, great centrifugal force acts on the surface of the lid member due to rotation of the rotor. With this centrifugal force, the solid existing on the side close to the bottom of the lid member is blown in a direction close to a direction perpendicular to the gas flow direction. Thus, even on the surface of the lid member on the side close to the bottom, the solid is not bounced toward the suction port, and does not come out of the vacuum pump.

DETAILED DESCRIPTION OF THE EXEMPLARY EMBODIMENTS

Figure 1:
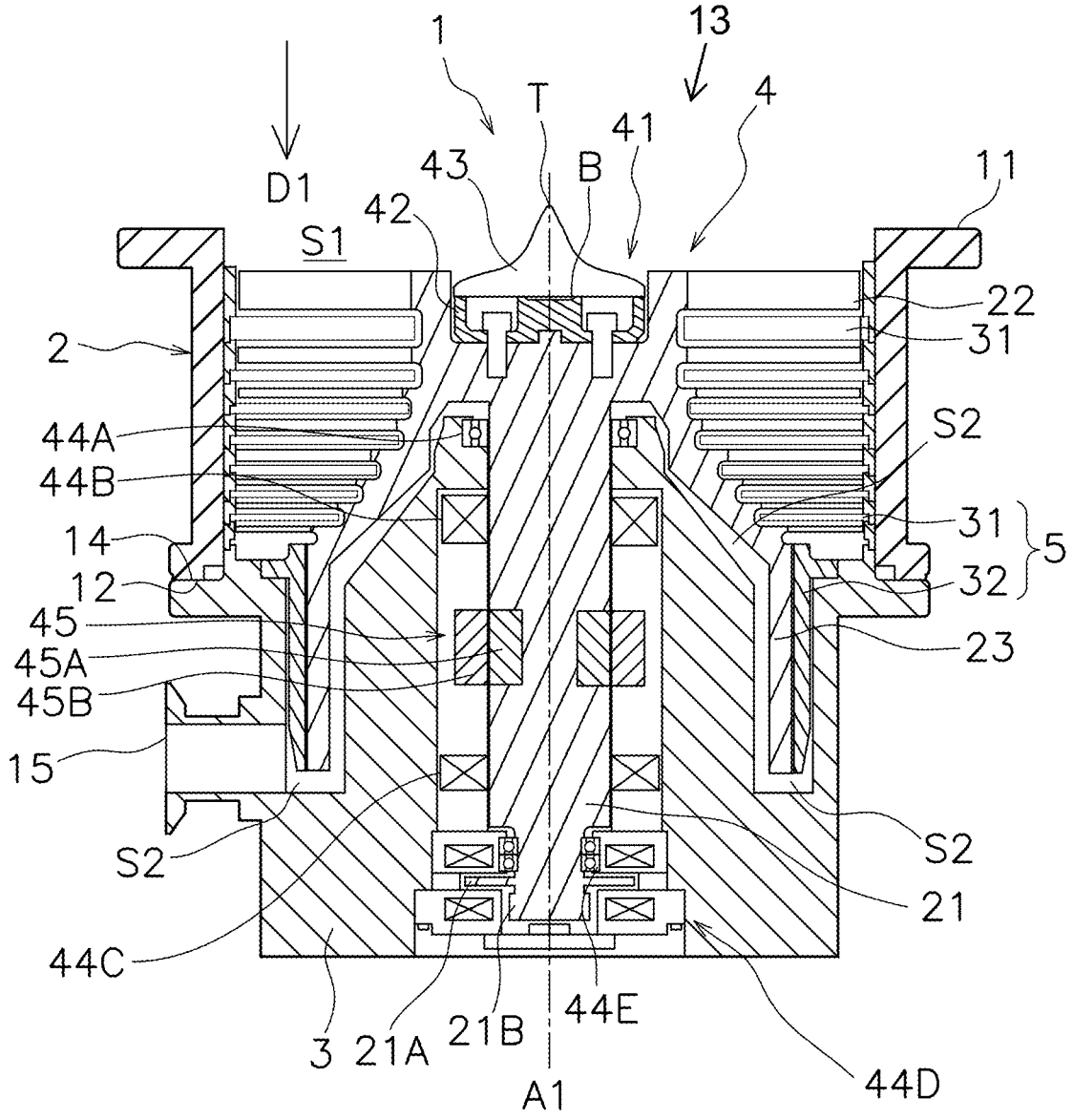
FIG. 1 is a sectional view of a vacuum pump.

Hereinafter, a vacuum pump will be described with reference to FIG. 1. FIG. 1 is a sectional view of a vacuum pump 1. The vacuum pump 1 includes a housing 2, a base 3, a rotor 4, and a stator 5.

The housing 2 includes a first end portion 11, a second end portion 12, and a first internal space S1. The first end portion 11 is provided with a suction port 13. The suction port 13 is connected to the inside of a pumping target device such that gas is flowable therebetween. The first internal space S1 communicates with the suction port 13. The second end portion 12 is located opposite to the first end portion 11 in the axial direction of the rotor 4 (hereinafter, simply referred to as an "axial direction A1"). The second end portion 12 is connected to the base 3. The base 3 includes a base end portion 14. The base end portion 14 is connected to the second end portion 12 of the housing 2. The base 3 is, for example, a member made of aluminum.

The rotor 4 is housed in the internal space of the housing 2. The rotor 4 includes a shaft 21. The shaft 21 extends in the axial direction A1. The shaft 21 is rotatably housed in the base 3. A lower portion of the shaft 21 is provided with a thrust disc 21A. A target 21B is screwed to the lower end of the shaft 21.

A recess 41 is provided on the side of the rotor 4 facing the suction port 13 (i.e., the upper end surface of the rotor 4). A balance disc 42 is attached to the bottom surface of the recess 41. The balance disc 42 is a member for balancing the rotor 4. A lid member 43 is attached to an upper end portion of the balance disc 42. The lid member 43 is disposed such that the center axis of the lid member 43 coincides with or is close to the rotation axis of the rotor 4. The lid member 43 is fixed onto the balance disc 42 with, e.g., a screw.

The lid member 43 is a member that covers the recess 41 of the rotor 4. The lid member 43 prevents a solid having passed through the suction port 13 from the pumping target device and having flowed into the housing 2 from entering the recess 41. By providing the lid member 43, it is possible to prevent accumulation of the solid in the recess 41 of the rotor 4.

The rotor 4 includes plural stages of rotor blades 22 and a rotor cylindrical portion 23. Each of the plural stages of rotor blades 22 is connected to the shaft 21 with inclined with respect to the axial direction A1. The plural stages of rotor blades 22 are spaced apart from each other in the axial direction A1. The plural stages of rotor blades 22 extend radially about the shaft 21. Note that in the drawings, only one of the plural stages of rotor blades 22 is denoted by a reference sign, and the reference signs of the other rotor blades 22 are omitted. The rotor cylindrical portion 23 is placed below the plural stages of rotor blades 22. The rotor cylindrical portion 23 extends in the axial direction A1.

The stator 5 is disposed on the outer peripheral side of the rotor 4. The stator 5 includes plural stages of stator blades 31 and a stator cylindrical portion 32. Each of the plural stages of stator blades 31 is connected to the inner surface of the housing 2 with inclined in a direction opposite to the inclination of the rotor blade 22. For example, when the rotor blade 22 is inclined from a suction side to an exhaust side, the stator blade 31 is inclined from the exhaust side to the suction side. On the other hand, when the rotor blade 22 is inclined from the exhaust side to the suction side, the stator blade 31 is inclined from the suction side to the exhaust side. The inclination directions of the rotor blade 22 and the stator blade 31 can be appropriately determined according to, e.g., the rotation direction of the rotor 4.

The plural stages of stator blades 31 are spaced apart from each other in the axial direction A1. Each of the plural stages of stator blades 31 is disposed between adjacent ones of the plural stages of rotor blades 22. The plural stages of stator blades 31 extend radially about the shaft 21. Note that in the drawings, only two of the plural stages of stator blades 31 are denoted by reference signs, and the reference signs of the other stator blades 31 are omitted. The stator cylindrical portion 32 is fixed in contact with the base 3. The stator cylindrical portion 32 is placed so as to face the outer peripheral surface of the rotor cylindrical portion 23 with a slight gap in the radial direction of the rotor cylindrical portion 23. A spiral groove is provided in the inner peripheral surface of the stator cylindrical portion 32 facing the rotor cylindrical portion 23.

As shown in FIG. 1, an exhaust space S2 is formed further downstream of pumping downstream end portions of the rotor cylindrical portion 23 and the stator cylindrical portion 32. Pumping target gas pumped from the pumping target device is guided to the exhaust space S2. The exhaust space S2 communicates with an exhaust port 15. The exhaust port 15 is provided in the base 3. Another vacuum pump is connected to the exhaust port 15. Note that the pumping downstream side represents a side closer to the exhaust space S2 in the axial direction A1. A pumping downstream direction represents a direction toward the exhaust space S2. The pumping downstream direction is referred to as a flow direction D1 of the pumping target gas.

The vacuum pump 1 includes bearings 44A, 44E, magnetic bearings 44B to 44D, and a motor 45. The bearings 44A, 44E are attached to the base 3 at positions at which the shaft 21 is housed. The bearings 44A, 44E rotatably support the shaft 21. The bearings 44A, 44E are ball bearings. The magnetic bearings 44B to 44D are bearings that support the shaft 21 by magnetic force. Of these magnetic bearings, the magnetic bearings 44B, 44C are radial magnetic bearings that support the shaft 21 in the radial direction. The magnetic bearing 44D is a thrust magnetic bearing that supports the shaft 21 in the axial direction.

The motor 45 rotationally drives the rotor 4. The motor 45 includes a motor rotor 45A and a motor stator 45B. The motor rotor 45A is attached to the shaft 21. The motor stator 45B is attached to the base 3. The motor stator 45B is disposed so as to face the motor rotor 45A.

In the vacuum pump 1, the plural stages of rotor blades 22 and the plural stages of stator blades 31 form a turbo-molecular pump portion. The rotor cylindrical portion 23 and the stator cylindrical portion 32 form a screw groove pump portion. In the vacuum pump 1, when the rotor 4 is rotated by the motor 45, the pumping target gas flows into the first internal space S1 from the inside of the pumping target device through the suction port 13. The pumping target gas in the first internal space S1 passes through the turbo-molecular pump portion and the screw groove pump portion, and is guided to the exhaust space S2. The pumping target gas in the exhaust space S2 is pumped through the exhaust port 15. As a result, the inside of the pumping target device attached to the suction port 13 is brought into a high vacuum state.

As described above, the vacuum pump 1 is provided with the lid member 43 that covers the recess 41 of the rotor 4. By providing the lid member 43, it is possible to prevent the solid having flowed in from the pumping target device through the suction port 13 from accumulating in the recess 41. In the present embodiment, further, the surface shape of the lid member 43 is determined such that the solid bounced on the surface of the lid member 43 is not bounced in a direction opposite to the flow direction D1 of the pumping target gas and come out of the vacuum pump 1 through the suction port 13.

Figure 2:
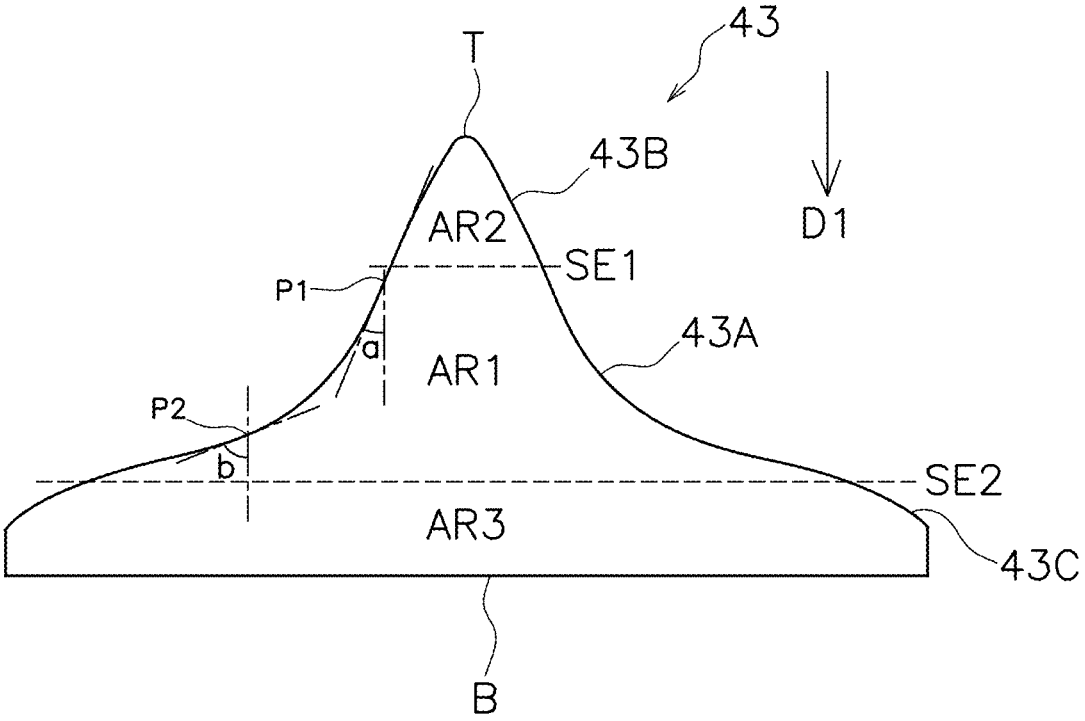
FIG. 2 is a view showing a detailed configuration of a lid member.

Hereinafter, the lid member 43 will be described in detail with reference to FIGS. 1 and 2. FIG. 2 is a view showing a detailed configuration of the lid member 43. As shown in FIG. 1, the lid member 43 has a cone shape having a vertex T on a side close to the suction port 13 and having a bottom B on a side close to the rotor 4. Specifically, the lid member 43 has a protruding conical shape with a vertex T side portion smaller.

More specifically, the lid member 43 has a conical shape expanding from the side close to the vertex T toward the side close to the bottom B. In other words, the generatrix of the lid member 43 is defined by such a curve that an angle between a tangent to the generatrix and the flow direction D1 of the pumping target gas increases from the vicinity of the vertex T to the vicinity of the bottom B. For example, as shown in FIG. 2, an angle a between a tangent P1 to a point on the generatrix of the lid member 43 on the side close to the vertex T and the flow direction D1 of the pumping target gas is smaller than an angle b between a tangent P2 to a point on the generatrix of the lid member 43 on the side close to the bottom B and the flow direction D1 of the pumping target gas. Here, the "generatrix of the lid member 43" means a line forming the side surface of the lid member 43, and corresponds to a side portion when the lid member 43 is cut along the flow direction D1.

As shown in FIGS. 1 and 2, the generatrix of the lid member 43 has two points (referred to as inflection points) at which the curvature of the curve changes. The generatrix of the lid member 43 can be divided into three regions at these two inflection points, and has different curves for each region. Specifically, as shown in FIG. 2, the generatrix of the lid member 43 can be divided into three regions by a first separatrix SE1 corresponding to the inflection point on the side close to the vertex T and a second separatrix SE2 corresponding to the inflection point on the side close to the bottom B. The intermediate region is referred to as a first region AR1, the region on the vertex T side is referred to as a second region AR2, and the region on the bottom B side is referred to as a third region AR3. Further, the generatrix of the first region AR1 is referred to as a first curved portion 43A, the generatrix of the second region AR2 is referred to as a second curved portion 43B, and the generatrix of the third region AR3 is referred to as a third curved portion 43C. That is, the generatrix of the lid member 43 includes three different curves of the first curved portion 43A, the second curved portion 43B, and the third curved portion 43C.

Figure 3:
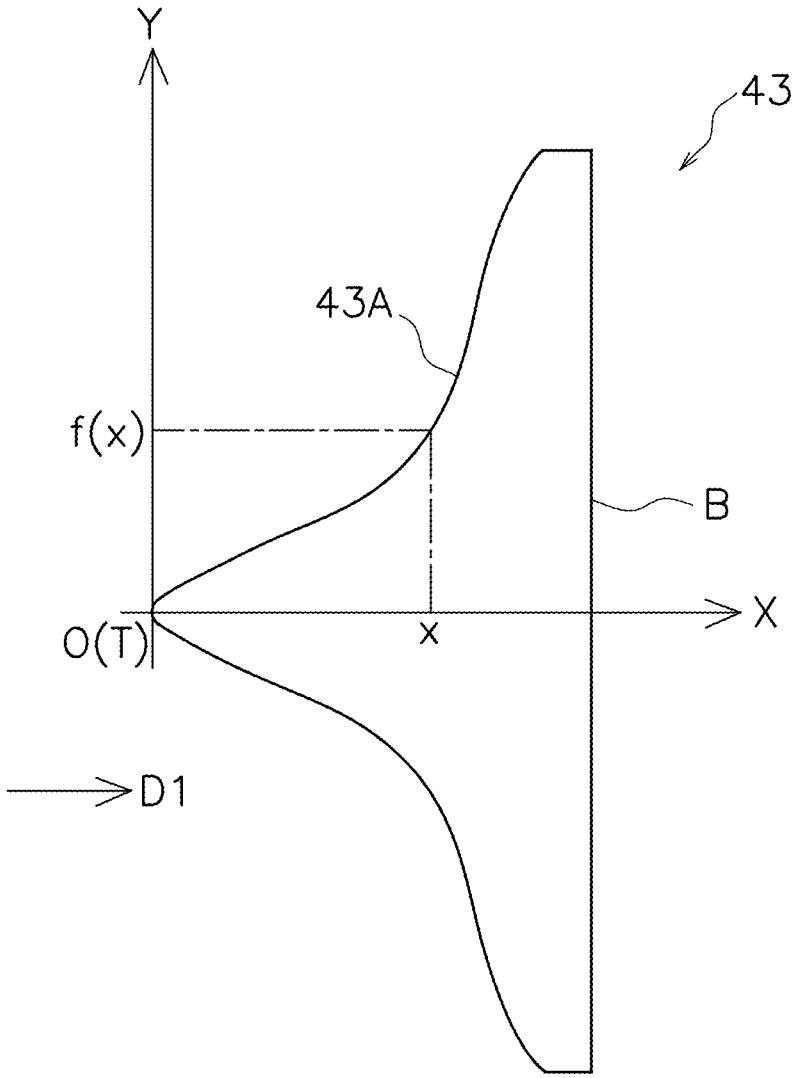
FIG. 3 is a view schematically showing that a first curved portion is expressed by a monotonically increasing function for a distance from a vertex.

Of these curved portions, the first curved portion 43A has such a curve that the angle between the tangent to the generatrix and the flow direction D1 of the pumping target gas increases from the vicinity of the vertex T to the vicinity of the bottom B. As shown in FIG. 3, on an X-Y coordinate system in which the vertex T is an origin O, an axis parallel to the flow direction D1 is an X-axis, and an axis perpendicular to the flow direction D1 is a Y-axis, the first curved portion 43A can be expressed as a monotonically increasing function of the value of the X-axis. Specifically, for an arbitrary value x of the X-axis, the shape of the first curved portion 43A can be expressed as a monotonically increasing function f(x). The monotonically increasing function f(x) can be, for example, a monotonically increasing polynomial (e.g., $a_1x^2+a_2x^3+\ldots+a_nx^n$ ($a_1, a_2, \ldots, a_n$: constant)) or an exponential function (e.g., $M^{N_x}$ (M, N: number greater than 1)) of a second or higher order for x. FIG. 3 is a view schematically showing that the first curved portion 43A is expressed by the monotonically increasing function for a distance from the vertex T.

In the above-described X-Y coordinate system, the value (x) of the X-axis corresponds to the distance from the vertex T in the flow direction D1. Since the first curved portion 43A is expressed by the monotonically increasing function f(x) for x, it can be paraphrased that the first curved portion 43A is expressed by the monotonically increasing function for the distance from the vertex T. The value (f(x)) of the Y-axis corresponds to a distance between the first curved portion 43A and the center axis (i.e., X-axis) of the lid member 43. Since the first curved portion 43A is expressed by the monotonically increasing function f(x) for the distance from the vertex T, the first curved portion 43A is placed at a position away from the center axis of the lid member 43 as approaching the bottom B (as the x value increases).

By expressing the first curved portion 43A by the monotonically increasing function for the distance x from the vertex T, the first curved portion 43A can be easily designed and manufactured. Note that the second curved portion 43B and the third curved portion 43C may also have shapes expressed as the function for the distance x from the vertex T.

The above-described first curved portion 43A has a surface at an angle close to the flow direction D1 on the side close to the suction port 13. Thus, on the surface of the first curved portion 43A on the side close to the suction port 13, the solid is not bounced toward the suction port 13, and does not come out of the vacuum pump 1.

On the other hand, the surface of the first curved portion 43A on the side close to the bottom B approaches a right angle to the flow direction D1, but is placed at a position away from the center axis of the lid member 43. Thus, great centrifugal force acts on the surface of the first curved portion 43A on the side close to the bottom B due to rotation of the rotor 4. With this centrifugal force, the solid having reached the side of the first curved portion 43A close to the bottom B is blown in a direction close to a direction perpendicular to the flow direction D1. Thus, on the surface of the first curved portion 43A on the side close to the bottom B, the solid is not bounced toward the suction port 13, and does not come out of the vacuum pump 1.

The second curved portion 43B is a curve connecting the vertex T of the lid member 43 and an upper end portion of the first curved portion 43A. Of the second curved portion 43B, a portion corresponding to the vertex T has a small hemispherical shape. Since the portion corresponding to the vertex T is formed in the hemispherical shape, it is possible to suppress the solid having flowed in through the suction port 13 from bouncing toward the suction port 13 as compared with a case where the vertex T is pointed. In a portion of the second curved portion 43B other than the vertex T, an angle between a tangent to such a portion and the flow direction D1 is small. Specifically, the angle between the tangent to the portion of the second curved portion 43B other than the vertex T and the flow direction D1 is smaller than the angle between the tangent to the first curved portion 43A and the flow direction D1. Thus, the solid is not bounced on such a portion of the second curved portion 43B toward the suction port 13, and does not come out of the vacuum pump 1.

As shown in FIG. 1, the portion of the second curved portion 43B corresponding to the vertex T protrudes from the upper end surface of the rotor 4 facing the suction port 13. With this configuration, it is possible to suppress turbulence of the flow of the pumping target gas at the vertex T of the lid member 43. That is, a flow along the curved side surface of the lid member 43 is easily generated, and the solid can be moved along this flow. As a result, it is possible to suppress the solid from bouncing toward the suction port 13 and coming out of the vacuum pump 1.

The third curved portion 43C is a curve connecting a lower end portion of the first curved portion 43A and the bottom B of the lid member 43. The tangent to the third curved portion 43C has an angle close to a right angle to the flow direction D1, but the third curved portion 43C is placed at a position away from the center axis of the lid member 43. Thus, great centrifugal force acts on the third curved portion 43C due to rotation of the rotor 4. With this centrifugal force, the solid having reached the third curved portion 43C is blown in a direction close to a direction perpendicular to the flow direction D1. Thus, even on the third curved portion 43C, the solid is not bounced toward the suction port 13, and does not come out of the vacuum pump 1.

As shown in FIGS. 1 and 2, the bottom B of the lid member 43 has a side parallel to the flow direction D1. Specifically, an angle between a tangent to a portion of the third curved portion 43C on the side close to the bottom B and the flow direction D1 is smaller than an angle between a tangent to a portion of the third curved portion 43C close to the first curved portion 43A and the flow direction D1.

One embodiment of the present invention has been described above, but the present invention is not limited to the above-described embodiment and various changes can be made without departing from the gist of the invention.

The vacuum pump 1 according to the above-described embodiment is a pump configured such that the turbomolecular pump formed by the plural stages of rotor blades 22 and the plural stages of stator blades 31 and the screw groove pump formed by the rotor cylindrical portion 23 and the stator cylindrical portion 32 are integrated. However, the screw groove pump may be omitted. Alternatively, the rotor blades 22 and the stator blades 31 may be omitted, and the vacuum pump 1 may include only the screw groove pump.

That is, the above-described lid member 43 can also be applied to a vacuum pump including only a turbo-molecular pump or a vacuum pump including only a screw groove pump.

In the above-described embodiment, the lid member 43 is attached onto the balance disc 42. The present invention is not limited thereto, and the lid member 43 may be directly fixed to the recess 41 of the rotor 4 with, e.g., a screw.

It is understood by those skilled in the art that the plurality of exemplary embodiments described above is specific examples of the following aspects.

(First Aspect) A vacuum pump (e.g., vacuum pump 1) according to a first aspect includes a housing (e.g., housing 2), a rotor (e.g., rotor 4), and a lid member (e.g., lid member 43). The housing has a suction port (e.g., suction port 13). The rotor is housed in the housing, and is rotationally driven to suck gas through the suction port and pump the gas. The rotor has a recess (e.g., recess 41) in a portion facing the suction port. The lid member covers the recess of the rotor. In the above-described vacuum pump, the lid member has a cone shape having a vertex (e.g., vertex T) on a side close to the suction port and having a bottom (e.g., bottom B) on a side close to the rotor. The generatrix of the cone shape includes a first curved portion (e.g., first curved portion 43A) having such a curve that an angle between a tangent to the generatrix and a gas flow direction increases from the vicinity of the vertex to the vicinity of the bottom.

The lid member of the vacuum pump according to the first aspect has the cone shape having the vertex on the side close to the suction port and having the bottom on the side close to the rotor. The generatrix of the cone shape includes the first curved portion having such a curve that the angle between the tangent to the generatrix and the gas flow direction increases from the vicinity of the vertex to the vicinity of the bottom. The lid member in such a shape has a surface at an angle close to the gas flow direction on the side close to the suction port. Thus, on the surface of the lid member on the side close to the suction port, a solid is not bounced toward the suction port, and does not come out of the vacuum pump. On the other hand, the surface of the lid member on the side close to the bottom is placed at a position close to an angle perpendicular to the gas flow direction but away from the center of the lid member. Thus, great centrifugal force acts on the surface of the lid member on the side close to the bottom due to rotation of the rotor. With this centrifugal force, the solid existing on the side close to the bottom of the lid member is blown in a direction close to a direction perpendicular to the gas flow direction. Thus, even on the surface of the lid member on the side close to the bottom, the solid is not bounced toward the suction port, and does not come out of the vacuum pump.

(Second Aspect) In the vacuum pump according to the first aspect, the generatrix of the cone shape of the lid member may include the first curved portion and a second curved portion (e.g., second curved portion 43B) closer to the vertex than the first curved portion. In the vacuum pump according to the second aspect, the vertex of the lid member and the first curved portion can be continuously and smoothly connected.

(Third Aspect) In the vacuum pump according to the second aspect, a portion of the second curved portion corresponding to the vertex of the lid member may have a hemispherical shape. In the vacuum pump according to the third aspect, it is possible to suppress the solid having flowed in through the suction port from bouncing toward the suction port as compared with a case where the vertex of the lid member is pointed.

(Fourth Aspect) In the vacuum pump according to any one of the first to third aspects, the first curved portion may be expressed by a monotonically increasing polynomial or an exponential function of a second or higher order for a distance from the vertex of the lid member. In the vacuum pump according to the fourth aspect, the first curved portion can be expressed by a mathematical formula, and therefore, the lid member can be easily designed and manufactured.

(Fifth Aspect) In the vacuum pump according to any one of the first to fourth aspects, the vertex of the lid member may protrude from the surface of the rotor facing the suction port. In the vacuum pump according to the fifth aspect, it is possible to suppress turbulence of the flow of the gas at the vertex of the lid member. That is, a flow along the curved side surface of the lid member is easily generated, and the solid can be moved along this flow. As a result, it is possible to suppress the solid from bouncing toward the suction port and coming out of the vacuum pump.

(Sixth Aspect) In the vacuum pump according to the second aspect, the generatrix of the cone shape may further include a third curved portion (e.g., third curved portion 43C) closer to the bottom than the first curved portion. In the vacuum pump according to the sixth aspect, the lid member can have a more optimal shape in which the solid is not bounced toward the suction port.

(Seventh Aspect) In the vacuum pump according to the sixth aspect, an angle between a tangent to a portion of the third curved portion on a side close to the bottom and the gas flow direction may be smaller than an angle between a tangent to a portion of the third curved portion on a side close to the first curved portion and the gas flow direction. In the vacuum pump according to the seventh aspect, the bottom of the lid member and the side surface other than the bottom can be smoothly connected.

(Eighth Aspect) In the vacuum pump according to the second aspect, a portion of the second curved portion other than the vertex may be formed such that an angle between a tangent to the portion and the gas flow direction is smaller than an angle between a tangent to the first curved portion and the gas flow direction. In the vacuum pump according to the eighth aspect, it is possible to suppress the solid from bouncing toward the suction port on the portion of the second curved portion other than the vertex.

(Ninth Aspect) In the vacuum pump according to any one of the first to eighth aspects, the lid member may have a conical shape expanding from the side close to the vertex toward the side close to the bottom. In the vacuum pump according to the ninth aspect, on the surface on the side close to the suction port, the solid is not bounced toward the suction port and does not come out of the vacuum pump. Great centrifugal force acts on the surface on the side close to the bottom of the lid member due to rotation of the rotor, and therefore, the solid is not bounced toward the suction port and does not come out of the vacuum pump.

(Tenth Aspect) In the vacuum pump according to any one of the first to ninth aspects, the first curved portion may have a surface at an angle close to the gas flow direction on the side close to the suction port such that the solid is not bounced toward the suction port. Further, on the side close to the bottom of the lid member, the first curved portion may be placed at a position close to an angle perpendicular to the gas flow direction but away from the center of the lid member such that the solid is blown by centrifugal force in a direction close to a direction perpendicular to the gas flow direction and is not bounced toward the suction port. In the vacuum pump according to the tenth aspect, the solid is not bounced toward the suction port, and does not come out of the vacuum pump.

What is claimed is:

1. A vacuum pump comprising:

a housing having a suction port;

a rotor housed in the housing, rotationally driven to suck gas through the suction port and pump the gas, and having a recess in a portion facing the suction port; and a lid that covers the recess of the rotor, wherein the lid has a cone shape having a vertex on a side close to the suction port and having a bottom on a side close to the rotor, and a generatrix of the cone shape includes a first curved portion having such a curve that an angle between a tangent to the generatrix of the cone shape and a gas flow direction increases from a vicinity of the vertex to a vicinity of the bottom, wherein the generatrix of the cone shape includes the first curved portion and a second curved portion closer to the vertex than the first curved portion, and wherein a portion of the second curved portion corresponding to the vertex has a hemispherical shape.

2. The vacuum pump according to claim 1, wherein the first curved portion is expressed by a monotonically increasing polynomial or an exponential function of a second or higher order for a distance from the vertex.

3. The vacuum pump according to claim 1, wherein the vertex protrudes from a surface of the rotor facing the suction port.

4. The vacuum pump according to claim 1, wherein the generatrix of the cone shape further includes a third curved portion closer to the bottom than the first curved portion.

5. The vacuum pump according to claim 4, wherein an angle between a tangent to a portion of the third curved portion on a side close to the bottom and the gas flow direction is smaller than an angle between a tangent to a portion of the third curved portion on a side close to the first curved portion and the gas flow direction.

6. The vacuum pump according to claim 1, wherein a portion of the second curved portion other than the vertex is formed such that an angle between a tangent to the portion of the second curved portion and the gas flow direction is smaller than an angle between a tangent to a portion of the first curved portion and the gas flow direction.

7. The vacuum pump according to claim 1, wherein the lid has a conical shape expanding from a side close to the vertex toward a side close to the bottom.

8. The vacuum pump according to claim 1, wherein the first curved portion has a surface at an angle close to the gas flow direction on the side close to the suction port such that a solid is not bounced toward the suction port, and on a side close to the bottom of the lid, is placed at a position close to an angle perpendicular to the gas flow direction but away from a center of the lid such that the solid is blown by centrifugal force in a direction close to a direction perpendicular to the gas flow direction and is not bounced toward the suction port.

* * * * *